US006432890B1

(12) United States Patent
Skold

(10) Patent No.: US 6,432,890 B1
(45) Date of Patent: Aug. 13, 2002

(54) METHOD FOR MECHANICAL WORKING IN THE PRESENCE OF A COBALT-CONTAINING METAL

(75) Inventor: Rolf Skold, Stenungsund (SE)

(73) Assignee: AB Chem Dimension, Stenungsund (SE)

( * ) Notice: Subject to any disclaimer, the term of this patent is extended or adjusted under 35 U.S.C. 154(b) by 0 days.

(21) Appl. No.: 09/786,117

(22) PCT Filed: Sep. 3, 1999

(86) PCT No.: PCT/SE99/01520

§ 371 (c)(1),
(2), (4) Date: Apr. 26, 2001

(87) PCT Pub. No.: WO00/14190

PCT Pub. Date: Mar. 16, 2000

(30) Foreign Application Priority Data

Sep. 7, 1998 (SE) ..... 9803004

(51) Int. Cl.[7] ..... C10M 173/02; C10M 141/10
(52) U.S. Cl. ..... 508/431; 508/437; 72/42
(58) Field of Search ..... 508/431, 437; 72/42

(56) References Cited

U.S. PATENT DOCUMENTS

| | | | | | |
|---|---|---|---|---|---|
| 3,963,628 | A | * | 6/1976 | Park | 252/8.8 |
| 4,191,658 | A | * | 3/1980 | Jahnke | 508/431 |
| 4,256,594 | A | * | 3/1981 | Rysek | 508/431 |
| 4,564,461 | A | * | 1/1986 | Skold et al. | 508/431 |
| 4,976,919 | A | * | 12/1990 | Skold et al. | 508/437 |
| 5,622,923 | A | * | 4/1997 | Mathur et al. | 508/431 |

FOREIGN PATENT DOCUMENTS

| | | |
|---|---|---|
| EP | A1120822 | 10/1984 |
| EP | A1180561 | 5/1986 |

* cited by examiner

*Primary Examiner*—Jacqueline V. Howard
(74) *Attorney, Agent, or Firm*—Birch, Stewart, Kolasch & Birch, LLP

(57) ABSTRACT

The present invention relates to a method for mechanically working of cobalt-containing metals or performing metal-working with a tool made of a metal containing cobalt. The method is carried out in the presence of an aqueous cooling lubricant containing a combination of an alkanolamine, a mono- or diphosphate ester and a mono- or dicarboxylic acid. The combination is capable of reducing both the release of cobalt ions and the corrosion of iron. In addition it also contributes essentially to the lubrication.

12 Claims, No Drawings

METHOD FOR MECHANICAL WORKING IN THE PRESENCE OF A COBALT-CONTAINING METAL

This application is the national phase under 35 U.S.C. §371 of PCT International Application No. PCT/SE99/01520 which has an International filing date of Sep. 3, 1999, which designated the United States of America.

The mechanical working of cemented carbides is usually carried out in the presence of an aqueous cooling lubricant which frequently contains an iron corrosion inhibitor, such as salts of monoethanolamine, diethanolamine or triethanolamine, and a lubricant, such as salts of fatty acids with 14–18 carbon atoms. When the large amounts of chips produced during the mechanical working and the piece of work itself are exposed to the aqueous cooling lubricant, corrosion processes take place which generate a high level of ionic cobalt in the aqueous cooling lubricant. The corrosion processes have a negative effect on the appearance and the dimension tolerances of the work piece or a work tool containing cobalt, while the high content of ionic cobalt constitutes a serious health problem for humans who come in contact herewith.

U.S. Pat. No. 4,315,889 discloses a method of reducing the release of cobalt by performing the metal working in the presence of a cooling lubricant containing, as an active component, a specific triazole or thiadiazole compound. However, since these active compounds are consumed in the presence of ethanolamines, the aqueous cooling lubricant has to be regularly upgraded.

EP-A-0180561 describes the use of a tertiary alkanol amine compound for reducing the release of cobalt and simultaneously maintaining the corrosion on a low level. According to the application the tertiary alkanol amine compound can advantageously be combined with carboxylic acids for further protection against the release of cobalt and the corrosion of iron.

According to the present invention it has now been found possible to further reduce the release of cobalt and corrosion of iron in comparison with the prior art, if the metal working is performed in the presence of an aqueous cooling lubricant having a pH between 6 and 10 and containing a) a phosphate ester of the formula

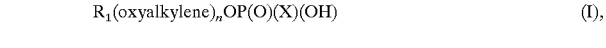

$$R_1(\text{oxyalkylene})_n OP(O)(X)(OH) \quad \text{(I)},$$

or

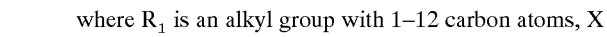

$$(HO)_2(O)P\text{-}(\text{oxyalkylene})_m\text{-}OP(O)(OH)_2 \quad \text{(II)},$$

where $R_1$ is an alkyl group with 1–12 carbon atoms, X is hydroxyl or the group $R_1O$, where $R_1$ has the above mention meaning, oxyalkylene is a group containing 2–4 carbon atoms, n is a number from 1–15 and m is a number from 4–20, or a salt thereof, b) a carboxylic acid of the formula

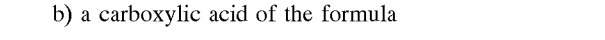

$$R_2(COOH)_P \quad \text{(III)},$$

where $R_2$ is an alkyl group with 4–10 carbon atoms and p is 1 or 2, or a salt thereof, and c) an alkanol amine of the formula

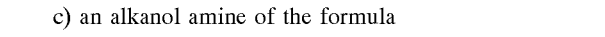

$$N(R_3)(R_4)(R_5) \quad \text{(IV)},$$

where $R_3$, $R_4$ and $R_5$ independently of each other designate a group $(AO)_nH$, where AO is an ethyleneoxy group or a propyleneoxy group and n is a number from 2–6, the total number of ethyleneoxy groups to the total number of propyleneoxy groups being between 2:1 and 1:3; in an amount of a) being 5–85% by weight, b) 5–85% by weight and c) 10–90% by weight, calculated on the total weight of a), b) and c). The combination of the phosphate ester, the carboxylic acid and the alkanol amine according to the present invention results in an essential reduction in the amount of released cobalt in comparison with a corrosion inhibitor consisting of a carboxylic acid and an alkanol amine. The compounds I, II, III and IV also contribute to the lubrication.

The alkanol amine of formula IV always contains at least 2 propyleneoxy groups. Preferably the alkanol amines are produced by ethoxylation of ammonia with 2–4 moles ethylene oxide followed by propoxylation with 4–7 moles per mole ammonia. The hydroxyl groups of these alkanol amines will consist of only secondary hydroxyl groups the relationship between the number of ethyleneoxy groups and the number of propyleneoxy groups is from 1:1 to 1:3.

The carboxylic acid of formula III contains an aliphatic group which can be saturated or unsaturated, straight or branched. Preferably the aliphatic group of monocarboxylic acids contains 5–9 carbon atoms, while the dicarboxylic acids preferably have an aliphatic group with 6–10 carbon atoms. Suitable examples of carboxylic acids are azelaic acid, pelargonic acid, sebacic acid, isononanoic acid, neodecanoic acid, n-octanoic acid, n-decanoic acid and dodecandioic acid. The carboxylic acids having a branched aliphatic group of the preferred size are often utilized, since they are low foaming.

In the phosphate esters of formulae I and II, the $(\text{oxyalkylene})_n$ group and $(\text{oxyalkylene})_m$ group respectively, are suitable selected in such a way that the esters will be water-soluble or easily dispersible in water. The aliphatic group $R_1$ can be saturated or unsaturated, straight or branched and contains preferably 2–8 carbon atoms. Preferably the phosphate ester component with formula I consists of at least 50% by weight of monoesters. In formula II the polyoxyalkylene chain preferably consists at least partially of oxyalkylene groups with 3–4 carbons atoms and m preferably is at least 6, since these diphosphates beside the corrosion inhibiting effect give a considerable contribution to the lubrication. Especially suitable are those diphosphate esters, which contains a polyoxypropypene chain with 5–10 oxypropylene units.

The content of the components a), b) and c) may vary within wide limits, but is normally between 0.1 and 10% by weight, preferably between 1 and 7% by weight of the cooling lubricant ready for use. The cooling lubricant can also contain a number of other additives, such as additional corrosion-inhibiting additives and lubricants, pH-regulating or controlling additives, bactericidal agents, viscosity-increasing additives, solubilizers, perfumes, colourants etc.

Examples of suitable additional corrosion inhibitors are amines compounds, such as triazole and thiadiazole compounds and inorganic compounds, such as alkali metal hydroxides and boric acid, and reaction products between boric acid and/or carboxylic acids with organic compounds, such as alkanol amines. The content of these additional corrosion inhibitors may be up to 3% by weight of the cooling lubricant.

Although the cooling lubricant containing a), b) and c) has an adequate lubrication ability for many applications it may be occasions where improved lubrication is desired. Examples of suitable lubricants to be incorporated into a cooling lubricant according to the invention are those selected from the group consisting of esters or amides of mono- or dicarboxylic acids having at least 12 carbon atoms in the acyl groups, mono- and dicarboxylic acids having more than 12 carbon atoms, organic aliphatic phosphate esters containing one or two aliphatic groups with 6–18 carbon atoms, nonionic alkylene oxide adducts with a molecular weight above 400, such as polypropylene glycols, glycols of randomly distributed propylenoxy and ethyleneoxy groups and block polymers of propylene oxide and ethylene oxide, and mixtures thereof The content of these additional lubricants may be up to 3% by weight of the cooling lubricant ready for use.

The solubilizers are usually low molecular compounds containing at least one hydroxyl. The molecular weight is normally below 400. Examples of suitable solubilizers are propypeneglycol, ethylene diethyleneglycol, butyl diethyleneglycol and butyl triethyleneglycol.

When preparing a cooling lubricant according to the invention, it is suitable to first prepare a concentrate, for example by adding the components a), b) and c) and, if so desired water, and then any supplementary ingredients. The amount of water is suitably between 5–80% by weight of the concentrate. A typical concentrate according to the invention has the following composition:

| | |
|---|---|
| components a + b + c | 20–95, preferably 50–90% by weight |
| additional corrosion inhibitors | 0–30, preferably 0–15% by weight |
| additional lubricants | 0–30, preferably 0–15% by weight |
| water | 5–80, preferably 10–50% by weight |
| other ingredients | 0–30, preferably 0–15% by weight |

The total amount of the additional corrosion inhibitors and lubricants and other ingredients is often 5–40% by weight of the concentrate. Before the concentrate is used, it is diluted with water so that the cooling lubricant ready for use will have a total content of a), b) and c) of 0.5–20% by weight, preferably 2–10% by weight.

The present invention is further illustrated by the following Example.

EXAMPLE

Cooling lubricants ready for use were prepared from the aqueous concentrates in the Table 1 below. The content of water was 30% by weight. The pH of the concentrates was adjusted to 9 by adding KOH before they were diluted with water to an active content of 4% by weight. The corrosion inhibiting effects on cobalt and iron of these fluids were determined at an ambient temperature of 22° C. by the following test methods.

Fe-corrosion tests were done by placing 30 grams of cast iron chips evenly spread on a circular filter paper with a diameter of 90 mm. 1.25 gram of one of the cooling lubricants was dispensed at the center of the filter paper, which was placed in a plastic Petri dish and covered by a lid. The corrosion taken place after 24 hours was determined by visually inspection of the rust staining according to a scale, where 0=no corrosion, 1=one stain, 2=two or three stains, 3=more than three stains up to to 10% of the paper surface discolored, 4=between 10 and 25% of the paper surface discolored, and 5=more than 25% of the paper surface discolored.

Co-corrosion tests were performed by assessing the amount of leached cobalt obtained, when a 20 ml glass vial containing 5 glass beads, 5 mg of fine powder of cobalt and 10 ml of one of the fluids was shaken for 7 days. The amount of cobalt dissolved was measured by use of an atomic absorption spectrophotometer (AAS). Initial screening of the fluids was done by using analytical sticks from Merck and only samples, which were found to contain less than 30 ppm of cobalt were subjected to AAS analysis.

The results obtained from the corrosion tests are shown in Table 2.

TABLE 1

| | Aqueous concentrates | | | | | | | |
|---|---|---|---|---|---|---|---|---|
| Components % by weight | I | II | III | IV | V | VI | VII | VIII |
| Composition | | | | | | | | |
| 1 | 20 | — | — | — | 50 | — | — | — |
| 2 | 20 | — | — | — | — | 50 | — | — |
| 3 | 20 | — | — | — | — | — | 50 | — |
| 4 | 20 | — | — | — | — | — | — | 50 |
| 5 | — | 20 | — | — | 50 | — | — | — |
| 6 | — | 20 | — | — | — | 50 | — | — |
| 7 | — | 20 | — | — | — | — | 50 | — |
| 8 | — | 20 | — | — | — | — | — | 50 |
| 9 | — | — | 20 | — | 50 | — | — | — |
| 10 | — | — | 20 | — | — | 50 | — | — |
| 11 | — | — | 20 | — | — | — | 50 | — |
| 12 | — | — | 20 | — | — | — | — | 50 |
| 13 | — | — | — | 20 | 50 | — | — | — |
| 14 | — | — | — | 20 | — | 50 | — | — |
| 15 | — | — | — | 20 | — | — | 50 | — |
| 16 | — | — | — | 20 | — | — | — | 50 |
| 17 | 10 | — | 10 | — | 50 | — | — | — |
| 18 | 10 | — | 10 | — | — | 50 | — | — |
| 19 | 10 | — | 10 | — | — | — | 50 | — |
| 20 | 10 | — | 10 | — | — | — | 50 | — |
| 21 | 10 | — | — | 10 | 50 | — | — | — |
| 22 | 10 | — | — | 10 | — | 50 | — | — |
| 23 | 10 | — | — | 10 | — | — | 50 | — |
| 24 | 10 | — | — | 10 | — | — | — | 50 |
| 25 | — | 10 | 10 | — | 50 | — | — | — |
| 26 | — | 10 | 10 | — | — | 50 | — | — |
| 27 | — | 10 | 10 | — | — | — | 50 | — |
| 28 | — | 10 | 10 | — | — | — | — | 50 |
| 29 | — | 10 | — | 10 | 50 | — | — | — |
| 30 | — | 10 | — | 10 | — | 50 | — | — |
| 31 | — | 10 | — | 10 | — | — | 50 | — |
| 32 | — | 10 | — | 10 | — | — | — | 50 |

Component I=phosphate ester, where $R_1$=hexyl, oxyalkylene=oxyethylene, n=5, X=hydroxyl, Component II=diphosphate, where oxyalkylene=oxypropylene, m=9, Component III=isononanoic acid, Component IV=neodecanoic acid, Component V=triethanolamine Component VI=triethanolamine+4 propylene oxide, Component VII=triethanolamine+5 propylene oxide, and Component VIII=triethanolamine+6 propylene oxide

TABLE 2

| Corrosion test results | | | | | | | | | | | | | | | | |
|---|---|---|---|---|---|---|---|---|---|---|---|---|---|---|---|---|
| Composition | 1 | 2 | 3 | 4 | 5 | 6 | 7 | 8 | 9 | 10 | 11 | 12 | 13 | 14 | 15 | 16 |
| Fe-corrosion | 0 | 0 | 1 | 3 | 0 | 0 | 2 | 3 | 0 | 0 | 1 | 0 | 0 | 1 | 1 | 2 |
| Co-corrosion ppm | 200 | 15 | 0 | 0 | 30 | 0 | 0 | 0 | 150 | 70 | 0 | 5 | 50 | 100 | 100 | 70 |
| Composition | 17 | 18 | 19 | 20 | 21 | 22 | 23 | 24 | 25 | 26 | 27 | 28 | 29 | 30 | 31 | 32 |
| Fe-corrosion | 0 | 0 | 1 | 0 | 0 | 0 | 0 | 1 | 0 | 0 | 0 | 1 | 0 | 0 | 0 | 0 |
| Co-corrosion ppm | 350 | 0 | 0 | 0 | 100 | 0 | 0 | 0 | 30 | 0 | 0 | 0 | 30 | 0 | 0 | 0 |

From the results it is evident that the metal working fluids formulated according to the invention, namely compositions 18, 19, 20, 22, 23, 24, 26, 27, 28, 30, 31 and 32, have excellent corrosion inhibiting properties as regards both cobalt and iron and are superior to the comparison fluids.

What is claimed is:

1. A method for mechanically working a metal containing cobalt or performing metal working with a metal tool containing cobalt, said method comprising the steps of:

(1) covering a working surface with an aqueous cooling lubricant, wherein said lubricant having a pH between 6 and 10 and comprising:

a) a phosphate ester of the formula $$R_1(\text{oxyalkylene})_n OP(O)(X)(OH) \quad \text{(I)},$$

or $$(HO)_2(O)P\text{-}(\text{oxyalkylene})_m\text{-}OP(O)(OH)_2 \quad \text{(II)},$$

wherein $R_1$ is an alkyl group with 1–12 carbon atoms, X is hydroxyl or the group $R_1O$, where $R_1$ has the above mentioned meaning, oxyalkylene is a group containing 2–4 carbon atoms, n is a number from 1–15 and m is a number from 4–20, or a salt thereof;

b) a carboxylic acid of the formula $$R_2(COOH)_p \quad \text{(III)},$$

wherein $R_2$ is an alkyl group with 6–12 carbon atoms and p is 1 or 2, or a salt thereof; and c) an alkanol amine of the formula $$N(R_3)(R_4)(R_5) \quad \text{(IV)},$$

wherein $R_3$, $R_4$ and $R_5$ independently of each other designate a group $(AO)_nH$, where AO is an ethyleneoxy group or a propyleneoxy group and n is a number from 2–6, the number of ethyleneoxy groups in relation to the number of propyleneoxy groups is between 2:1 and 1:3, the amount of a) being 5–85% by weight, b) 5–85% by weight and c) 10–90% by weight, calculated on the total weight of a), b) and c);

(2) performing the metal working in the presence of said lubricant.

2. A method according to claim 1, wherein said alkanol amine IV has three secondary hydroxyl groups.

3. A method according to claim 1, wherein said diphosphate ester II comprises a polyoxyalkylene chain, which at least partially consists of oxyalkylene groups with 3–4 carbon atoms, and the phosphate ester I consists of at least 50% by weight of monoesters.

4. A method according to claim 1 or 2, wherein said carboxylic acid of formula III is a monocarboxylic acid, where $R_2$ is a branched aliphatic group with 5–9 carbon atoms or a dicarboxylic acid, where $R_2$ is a branched aliphatic group with 6–10 carbon atoms.

5. A method according to claim 1 or 2, wherein in said alkanol amine of formula IV the number of ethyleneoxy groups to the number of propyleneoxy groups is between 1:1 and 1:3.

6. An aqueous cooling composition for metal working, said composition comprising:

(a) a phosphate ester of the formula $$R_1(\text{oxyalkylene})_n OP(O)(X)(OH) \quad \text{(I)},$$

or $$(HO)_2(O)P\text{-}(\text{oxyalkylene})_m\text{-}OP(O)(OH)_2 \quad \text{(II)},$$

wherein $R_1$ is an alkyl group with 1–12 carbon atoms, X is hydroxyl or the group $R_1O$, where $R_1$ has the above mentioned meaning, oxyalkylene is a group comprising 2–4 carbon atoms, n is a number from 1–15 and m is a number from 4–20, or a salt thereof, the amount of a) is 5–85% by weight;

(b) a carboxylic acid of the formula $$R_2(COOH)_p \quad \text{(III)},$$

wherein $R_2$ is an alkyl group with 6–12 carbon atoms and p is 1 or 2, or a salt thereof, the amount of b) is 5–85% by weight;

(c) an alkanol amine of the formula $$R_1(\text{oxyalkylene})_n OP(O)(x)(OH) \quad \text{(I)},$$

or $$(HO)_2(O)P\text{-}(\text{oxyalkylene})_m\text{-}OP(O)(OH)_2 \quad \text{(II)},$$

wherein $R_1$ is an alkyl group with 1–12 carbon atoms, X is hydroxyl or the group $R_1O$, where $R_1$ has the above mentioned meaning, oxyalkylene is a group containing 2–4 carbon atoms, n is a number from 1–15 and m is a number from 4–20, or a salt thereof; an alkanol amine of the formula $$N(R_3)(R_4)(R_5) \quad \text{(IV)},$$

wherein $R_3$, $R_4$ and $R_5$ independently of each other designate a group $(AO)_nH$, where AO is an ethyleneoxy group or a propyleneoxy group and n is a number from 2–6, the number of ethyleneoxy groups in relation to the number of propyleneoxy groups is between 2:1 and 1:3, the amount of c) is 10–90% by weight;

| | |
|---|---|
| (d) additional corrosion inhibitors | 0–30% by weight; |
| (e) additional lubricants | 0–30% by weight; |
| (f) water | 5–80% by weight; |
| (g) other ingredients | 0–30% by weight; |

wherein the total amount of component (a), (b) and (c) is 20–95% by weight of the cooling composition.

7. The aqueous cooling composition of claim 6, said composition comprising:

(a) a phosphate ester of the formulae $$R_1(\text{oxyalkylene})_n OP(O)(X)(OH) \quad \text{(I)},$$

or $$(HO)_2(O)P\text{-}(\text{oxyalkylene})_m\text{-}OP(O)(OH)_2 \quad \text{(II)},$$

wherein $R_1$ is an alkyl group with 1–12 carbon atoms, X is hydroxyl or the group $R_1O$, where $R_1$ has the above mentioned meaning, oxyalkylene is a group containing 2–4 carbon atoms, n is a number from 1–15 and m is a number from 4–20, or a salt thereof, the amount of a) is 5–85% by weight;

(b) a carboxylic acid of the formula $$R_2(COOH)_p \quad \text{(III)},$$

wherein $R_2$ is an alkyl group with 6–12 carbon atoms and p is 1 or 2, or a salt thereof, the amount of b) is 5–85% by weight;

(c) an alkanol amine of the formula $$N(R_3)(R_4)(R_5) \quad \text{(IV)},$$

wherein $R_3$, $R_4$ and $R_5$ independently of each other designate a group $(AO)_nH$, where AO is an ethyleneoxy group or a propyleneoxy group and n is a number from 2–6, the number of ethyleneoxy groups in relation to the number of propyleneoxy groups is between 2:1 and 1:3, the amount of c) is 10–90% by weight;

| | |
|---|---|
| (d) additional corrosion inhibitors | 0–15% by weight; |
| (e) additional lubricants | 0–15% by weight; |
| (f) water | 10–50% by weight; |
| (g) other ingredients | 0–15% by weight; |

wherein the total amount of component (a), (b) and (c) is 50–90% by weight of the cooling composition.

8. The aqueous cooling composition according to claim 6, wherein the total amount of the additional corrosion inhibitors, additional lubricants, and other ingredients is between 4 and 40% by weight of the cooling composition.

9. The aqueous cooling composition according to claim 7, wherein the total amount of the additional corrosion inhibitors, additional lubricants, and other ingredients is between 4 and 40% by weight of the cooling composition.

10. The aqueous cooling composition according to claim 6 having a pH between 6 and 10.

11. A process of making a corrosion inhibitor for cobalt comprising the step of mixing:

a) a phosphate ester of the formula $$R_1(\text{oxyalkylene})_n OP(O)(X)(OH) \quad \text{(I)},$$

or $$(HO)_2(O)P\text{-}(\text{oxyalkylene})_m\text{-}OP(O)(OH)_2 \quad \text{(II)}$$

wherein $R_1$ is an alkyl group with 1–12 carbon atoms, X is hydroxyl or the group $R_1O$, where $R_1$ has the above mentioned meaning, oxyalkylene is a group comprising 2–4 carbon atoms, n is a number from 1–15 and m is a number from 4–20, or a salt thereof;

b) a carboxylic acid of the formula $$R_2(COOH)_p \quad \text{(III)},$$

wherein $R_2$ is an alkyl group with 6–12 carbon atoms and p is 1 or 2, or a salt thereof; and c) an alkanol amine of the formula $$N(R_3)(R_4)(R_5) \quad \text{(IV)}$$

wherein $R_3$, $R_4$ and $R_5$ independently of each other designate a group $(AO)_nH$, where AO is an ethyleneoxy group or a propyleneoxy group and n is a number from 2–6, the number of ethyleneoxy groups in relation to the number of propyleneoxy groups is between 2:1 and 1:3, the amount of a) being 5–85% by weight, B) 5–85% by weight and c) 10–90% by weight, calculated on the total weight of a), b) and c).

12. A process according to claim 11 further comprising the step of mixing a), b), and C) at a pH between 6 and 10.

* * * * *